United States Patent [19]

Ogilvie et al.

[11] Patent Number: 5,032,184

[45] Date of Patent: Jul. 16, 1991

[54] METHOD FOR ASPIRATING LIQUID FROM SURGICAL OPERATING ROOM FLOORS

[75] Inventors: Rick A. Ogilvie, Ancaster, Canada; Rance A. Winkler, Largo, Fla.

[73] Assignee: Concept, Inc., Largo, Fla.

[21] Appl. No.: 575,565

[22] Filed: Aug. 31, 1990

Related U.S. Application Data

[62] Division of Ser. No. 436,774, Nov. 15, 1989, Pat. No. 5,014,389.

[51] Int. Cl.[5] ..... B08B 5/04

[52] U.S. Cl. ..... 134/21; 15/353; 15/393; 15/401

[58] Field of Search ..... 134/21; 15/227, 353, 15/393, 401

[56] References Cited

U.S. PATENT DOCUMENTS

| | | | |
|---|---|---|---|
| 2,243,935 | 6/1941 | Williamson | 15/322 |
| 3,029,463 | 4/1962 | Bishop | 15/314 |
| 3,605,171 | 9/1971 | Candor et al. | 15/322 |
| 4,041,569 | 8/1977 | Peterson | 15/353 |

*Primary Examiner*—Theodore Morris
*Assistant Examiner*—Saeed Chaudhry
*Attorney, Agent, or Firm*—Epstein, Edell & Retzer

[57] ABSTRACT

A method and apparatus for aspirating fluids from a surgical operating room utilizing a suction head that readily slides along the floor in response to translational forces applied by foot by operating room personnel. The suction head has a flat bottom surface with a plurality of narrow flow channels defined therein between a suction port mouth and the surface periphery. Support ribs, disposed on the top surface in juxtaposed alignment with respective flow channels, impart strength to the suction head and prevent sealing of the flow channels. The suction head is adapted to operate with suction sources commonly available in surgical operating rooms operating through a fluid waste collection chamber. The flow channels conduct fluid to be aspirated while preventing the bottom surface from becoming sealed to the floor.

20 Claims, 2 Drawing Sheets

METHOD FOR ASPIRATING LIQUID FROM SURGICAL OPERATING ROOM FLOORS

This is a divisional application of application Ser. No. 07/436,774 filed Nov. 15, 1989, now U.S. Pat. No. 5,014,389.

BACKGROUND OF THE INVENTION

1. Technical Field

The present invention relates to a method and apparatus for removing fluid matter that drains or spills onto the floor during a surgical procedure. More particularly, the invention relates to a disposable foot-manipulated suction head and hose attachment adapted for use with suction sources commonly available in surgical operating rooms.

2. Discussion of the Prior Art

During the course of surgery, and particularly during arthroscopic surgery, waste fluids of various types find their way to the floor of the operating room. Specifically, during arthroscopic surgery sterile fluid (e.g., saline) is supplied to the surgical site as a distension medium for the joint. This fluid, if permitted to drain uncontrolled to the floor, presents a safety hazard in that operating room personnel are likely to slip and fall. The possible contamination of the fluid presents an additional hazard.

A prior art approach toward solving this problem is disclosed in U.S. Pat. Nos. 4,679,590 and 4,729,404. These patents disclose a rubber mat adapted for placement beneath a surgical site in sealed engagement with the floor. The top surface of the mat is configured as multiple inverted pyramidal elements configured to collect fluid and direct it to a drain hole on the bottom side of the mat. The bottom side of the mat is provided with flow channels that become sealed to the floor and converge to a common suction port adapted for connection to a source of suction that is commonly available at wall-mounted suction ports in surgical operating rooms. The suction delivers the recovered fluid to a canister for disposal.

Although the suction mat arrangement described above adequately removes fluid that falls on the mat, it cannot drain the rather significant amount of fluid that falls to the floor beyond the mat periphery. During arthroscopic surgery the sterile fluid delivered to the surgical site is often delivered at relatively high pressures, thereby making it difficult, if not impossible, for surgical personnel to direct the fluid so that, after flowing from the surgical site, it falls on the suction mat.

There are commercially available vacuum cleaners with movable suction heads adapted to draw liquid from floors toward a waste collection chamber. These devices, however, are not suitable for surgical environments for a number of reasons, not the least of which is the fact that the vacuum cleaner suction head must be manipulated by hand in order to be positioned at various spillage locations on the floor. Since the hands of operating room personnel are otherwise occupied during a surgical procedure, the use of a commercial vacuum cleaner would require additional personnel, thereby adding to the already high cost of surgery. Moreover, commercially available vacuum cleaners have built-in vacuum sources that are extremely noisy, thereby rendering communication between the surgeon and nurses difficult at best. It would be far more desirable to use a low level suction source (e.g., on the order of 300 millimeters of mercury below atmospheric pressure) such as is commonly available at a wall port in operating rooms; however, suction heads employed with commercial vacuum cleaners are incapable of operating at such low pressures.

Finally, the fluids that spill onto the floor during a surgical procedure are likely to be or become contaminated. Commercially available vacuum cleaner heads for liquids are not designed to be disposable after use and, accordingly, would become contaminated and present a health hazard.

OBJECTS AND SUMMARY OF THE INVENTION

Accordingly, it is a primary object of the present invention to provide a method and apparatus for efficiently removing fluid from surgical room floors without the disadvantages and hazards present in prior art methods and apparatus.

It is another object of the present invention to provide a suction head adapted for use with low level suction and capable of being easily translated along a surgical room floor without occupying the hands of surgical personnel.

Another object of the present invention is to provide a method for removing fluids from surgical room floors whereby a surgeon, nurse or other attending personnel can readily translate a suction head to different locations on the floor with his or her foot.

A further object of the present invention is to provide a suction head for use in conjunction with available suction sources in surgical operating rooms, the suction head being sufficiently inexpensive to be disposable after a single surgical procedure, relatively quiet in operation, and easily translated along the floor to locations of spilled fluid without detracting personnel from the surgical procedure.

In accordance with the present invention, a suction head for use in removing waste fluids from surgical operating room floors has a planar, low-friction bottom surface adapted to readily slide along the floor in response to translational forces applied by a foot of a surgeon, nurse or other surgery personnel. Flow channels recessed in the bottom surface extend from the periphery of the suction head to the mouth of a common suction port adapted for connection by flexible tubing to a waste fluid collection container or canister. The canister is also connected by means of a hose to a wall mounted suction port providing a negative low pressure on the order of 300 millimeters of mercury below atmospheric pressure. In the preferred embodiment, the suction head is a thin one-piece molded plate, preferably of resilient plastic material having a heat distortion temperature less than 270° F. so as to be sufficiently inexpensive to be discarded after each surgical procedure. The common suction port is defined as a tubular hose fitting extending upwardly from the top surface of the plate. Multiple support ribs extend along the top surface from the hose fitting to the suction head periphery in juxtaposition with respective flow channels to reinforce the flow channels against collapse and flow blockage.

BRIEF DESCRIPTION OF THE DRAWINGS

These and other objects, features and many of the attendant advantages of the present invention will be appreciated more readily as they become better understood from a reading of the following description considered in connection with the accompanying drawings wherein like parts in each of the several figures are identified by the same reference numerals, and wherein.

DESCRIPTION OF THE PREFERRED EMBODIMENT

Figure 1:
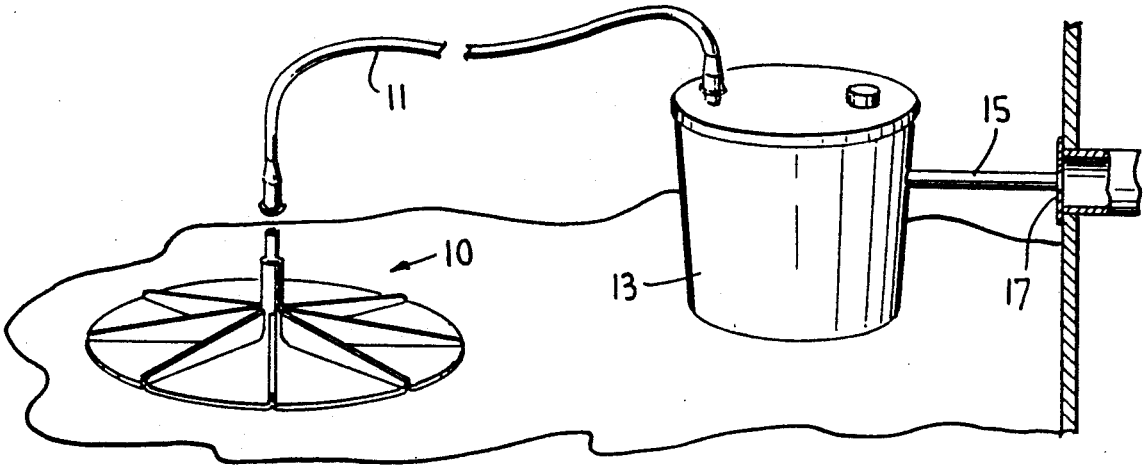
FIG. 1 is a view in perspective of a suction system employing a suction head in accordance with the present invention.

Referring specifically to FIG. 1 of the accompanying drawings, a suction system according to the present invention includes a suction head 10 connected by a flexible hose 11 to a waste liquid collection canister 13. Another hose 15 is connected between the canister 13 and a wall suction port 17 of the type commonly found in surgical operating rooms for supplying low level suction on the order of 300 millimeters of mercury below atmospheric pressure. Hoses 11 and 15 communicate with the interior of canister 13 through respective fittings at or near the canister top. Suction from the wall port is applied through the canister to suction head 10, and the aspirated fluid, upon reaching the canister, is sufficiently heavy in relation to the low suction to drop into the canister for collection and eventual disposal.

As described in detail below, suction head 10 is made to be disposable after a single surgical procedure; hose 11 may be similarly disposable. If canister 13 is provided with a permanent collection hose, disposable hose 11 may be inserted between that permanent hose and suction head 10. In any case, the hosing between canister 13 and suction head 10 is very flexible to permit free translation of suction head 10 along the floor of the operating room. Such translation is readily effected by translational forces applied to the suction head by the foot of a surgeon, nurse or other surgical personnel who might lightly kick, push or drag the suction head with his or her foot.

Figure 2:
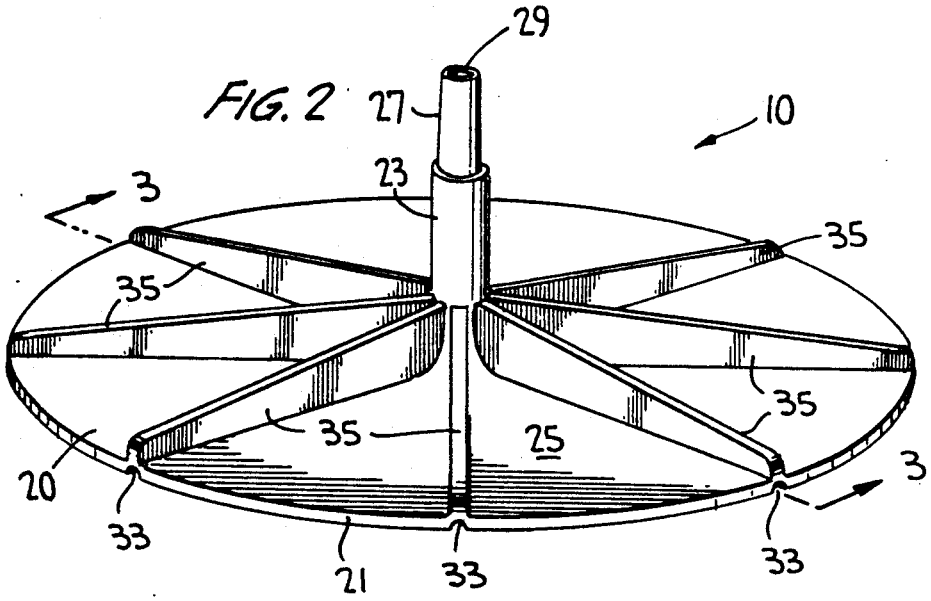
FIG. 2 is a top view in perspective of one embodiment of the suction head of the present invention.
Figure 3:
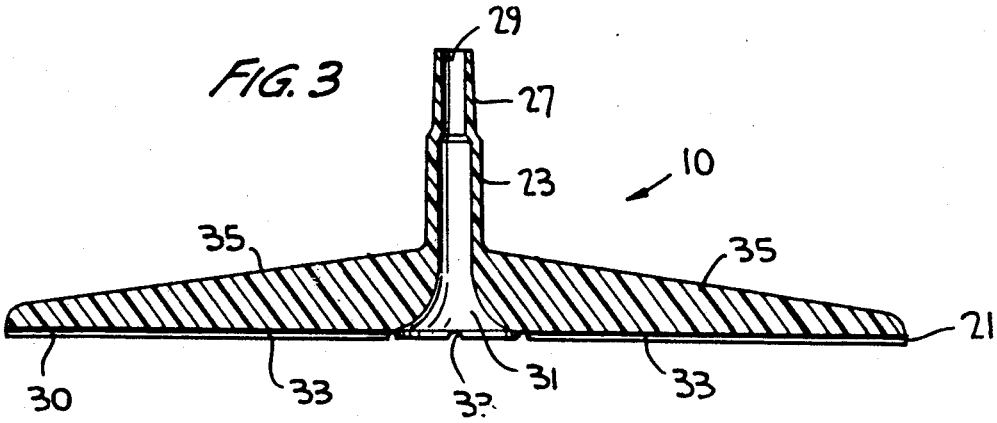
FIG. 3 is a view in section taken along line 3—3 of FIG. 2.
Figure 4:
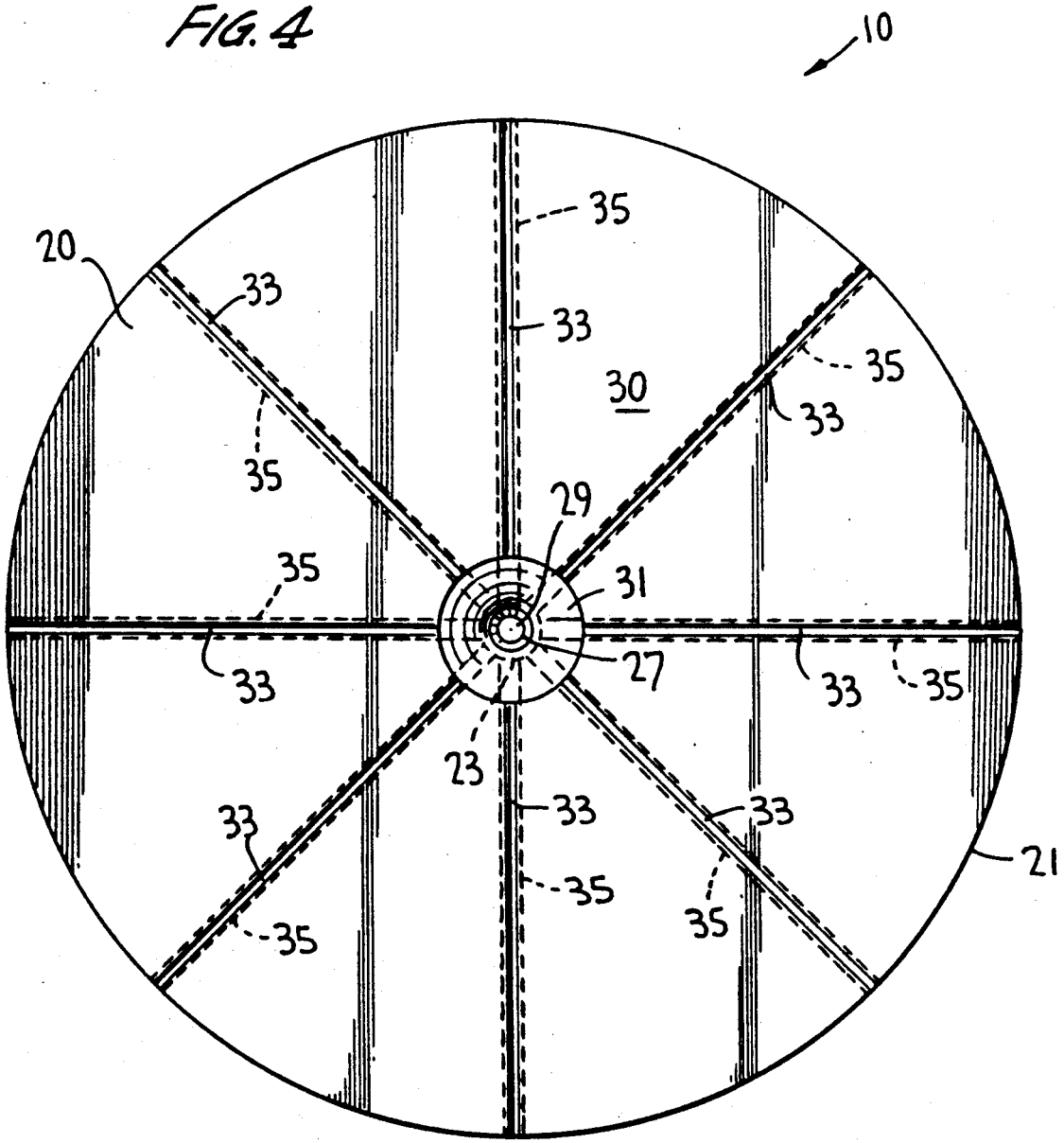
FIG. 4 is a bottom view in plan of the suction head of FIG. 2.

The preferred embodiment of suction head 10 of FIG. 1 is illustrated in greater detail in FIGS. 2, 3 and 4 to which specific reference is now made. The suction head is molded as a disposable single piece of lightweight resin material, preferably low density polypropylene, weighing on the order of four ounces with a heat distortion temperature below 270° F. to preclude attempts to sterilize the suction head after use. More specifically, because the suction head is likely to be exposed to contaminated or unsanitary fluids during use, it should not be re-used. If the suction head were able to withstand high sterilization temperatures (e.g., in an autoclaving procedure), users would not dispose of the suction head after use but would, instead, sterilize the head for re-use. When personnel are in the habit of re-using, rather than discarding, suction heads, it is possible that some suction heads may inadvertently not have been subjected to a sterilization procedure. The resulting contamination hazard is significant but may be avoided where personnel are in the habit of discarding inexpensive suction heads after each use with the knowledge that the suction heads cannot withstand sterilization temperatures.

Suction head 10 includes a circular plate 20 having a peripheral edge 21 and a hollow post 23 extending generally upwardly from its top surface 25. In the preferred embodiment, post 23 is generally cylindrical and centered on top surface 25 and is perpendicular thereto. A hose fitting 27 at the upper end of post 23 is formed as a smaller diameter extension of the post, the diameter being slightly greater than the inside diameter of hose 11 (FIG. 1) so that the fitting can be resiliently engaged within the hose. If desired, the engagement between hose 11 and fitting 27 can be secured by a hose clamp, or the like. An internal bore 29 extends longitudinally through the entire post 23 to a mouth 31 opening at the flat bottom surface 30 of the plate 20. Mouth 31 gradually widens from bore 29 as it approaches bottom surface 30 with a predetermined curvature, thereby providing a funnel-like construction.

A plurality of narrow flow channels 33 are defined in bottom surface 30 and extend from mouth 31 to the peripheral edge 21 of plate 20. For a circular plate 20 with its centered mouth 31 as configured in the preferred embodiment, the flow channels 33 are oriented radially, are eight in number and are spaced at equal angular intervals. It will be appreciated that the mouth 31 and/or port 23 need not be centered on plate 20 which, in turn, need not be circular. What is important, therefore, is that channels 33 communicate with bore 29, wherever it may be located, and with the plate periphery 21, whatever the shape of the plate. Flow channels 33 are both narrow and shallow so as to have a relatively small cross-sectional area. In the preferred embodiment the channels 33 each have semi-circular transverse cross-sections with a 0.03 inch radius for a plate 20 having an eight inch diameter, a mouth 31 approximately 1.0 inch in diameter, and a thickness of 0.10 inch. The total area of bottom surface 30 occupied by the eight flow channels 33 and mouth 31 in this preferred embodiment is, therefore, approximately 1.7 square inches. The area bounded by peripheral edge 21 is approximately 50.26 square inches. Accordingly, the ratio of these areas is approximately thirty-to-one. In order to provide a desired flow rate through suction head 10 in the range of 600–750 ml/min for a suction source pressure of 300 mm of mercury below ambient as described above, the area ratio should preferably not be less than twenty-to-one.

A plurality of support ribs 35 extend along top surface 25 from post 23 to periphery 21, and taper downwardly in height toward the periphery. Each rib is in juxtaposed relation with a corresponding flow channel 33 defined in bottom surface 30. The ribs are thicker than the flow channels and provide support for flexible plate 20 while preventing the channels 33 from collapsing due to the suction forces or from downward pressure if the suction head is accidently stepped on with the full weight of an individual. More specifically, the thicker ribs 35 distribute downwardly directed forces onto the non-recessed portion of bottom surface 30 rather than having such forces focused directly onto the channels 33. In addition, the semi-circular cross-section of the channels distributes downward forces along the channel side and away from the channel center, thereby acting in conjunction with the ribs to prevent channel collapse. This cross-section need not be semi-circular to accomplish this function; rather, it is only necessary that the channel width not be so large, relative to the channel depth, as to facilitate collapse. A ratio of channel width to channel depth on the order of three-to-one or less is satisfactory for this purpose.

In the preferred embodiment as described above, ribs 35 are 0.10 inch thick, have a maximum height adjacent post 23 of 0.73 inch, and a minimum height at periphery 21 of 0.22 inch. The downward taper angle of the ribs is eight degrees. The overall height of the suction head 10, from the top of fitting 27 to bottom surface 30, is 2.38 inches. Fitting 27 is 0.63 inch long with an upward taper angle of 1.5° and a minimum outside diameter of 0.359 inch. The inside diameter of fitting 27 is 0.18 inch. The lower portion of post 23 is 1.02 inch long and has an outside diameter that is 0.475 inch at its base with an upward taper of 1.5°. The inside diameter of post 23 is 0.28 inch. It is to be understood that all of these dimensions are by way of example only and are not limiting on the scope of the invention.

Although the suction head structure has been described and illustrated for a preferred embodiment, it is apparent that modifications may be made to the suction head within the scope of the present invention. For example, suction head 10 is preferably made from a molded synthetic resin to provide a disposable product; however, the suction head may be formed from any suitable material, such as metal, resin, impregnated fiberglass, or the like. The shape of the plate 20 has been illustrated as circular but any suitable regular or irregular shape may be employed, such as rectangular, ovoid, triangular, etc. A plate having any of these configurations is, in any case, provided with recessed channels 33 defined in the bottom surface 30 of the plate to communicate or extend from the periphery of the plate to the recessed mouth opening 31 of suction port 29. The recessed channels need not extend radially but, instead, may have any suitable configuration to provide the necessary passages for fluids being aspirated into suction port 29. Further, the channel cross-section need not be semi-circular but, instead, may be triangular, rectangular, irregular, etc.

Suction port 29, as illustrated in FIGS. 2–4, has a recessed mouth opening; however, it is apparent that the suction forces applied to flow channels 33 in the bottom surface 30 of plate 20 may be supplied through a number of various recessed manifold configurations. Such configurations include one or a plurality of apertures communicating between recessed channels 33 and suction port 29.

A primary feature of suction head 10 of the present invention is that it is readily manipulated by the foot of the surgeon, nurse or other personnel so as to be translated to locations on the floor at which liquid has been spilled. The translational forces are most easily applied to edge 21 at the distal end of a rib 35 and in a direction parallel to plate 20. As the ribs 35 are in radial alignment with flow channels 33, the ribs perform the additional function of structurally reinforcing the plate 20 at locations above the flow channels to prevent collapse of the channels, particularly at the periphery 21 of the plate, in the event that downward foot pressure is applied directly above a channel 33. Such collapse would create a suction seal under suction head 10 during operation, resulting in a decrease of manipulatability.

In the preferred embodiment of the present invention the bottom surface 30 of plate 20 is essentially a circular planar surface having a plurality of recessed channels 33 extending radially from the suction port 29 to the periphery of the plate. As the suction head rests on the floor, a major proportion of the area of bottom surface 30 contacts the floor surface. Therefore, the material employed for plate 20 must have a low coefficient of friction, or the bottom surface must be provided with a coating having a low coefficient of friction, in order to permit free movement of the suction head about the floor while suction is applied through suction port 29 and flow channels 33. Bottom surface 30 thus defines a support plane enabling the suction head to be easily moved about the floor surface from which fluid is to be aspirated. It is necessary only to provide the bottom surface in a configuration suitable to enable the suction head 30 to engage the floor surface with sufficient suction to remove fluids from the surface without preventing the suction head from being freely moved along the surface by minimal forces exerted in the translational direction.

The invention is also directed to a one-piece molded suction head 10 in combination with a hose 11 which may be utilized as a one-piece disposable unit.

From the foregoing description it will be appreciated that the present invention makes available a novel method and apparatus whereby a disposable suction head, in the form of a plate having a flat bottom surface with flow channels defined therein from the plate periphery to a common suction port, cooperates with a low level suction source commonly available in operating rooms, to remove spilled liquids at various locations that are accessible by foot manipulation of the suction head.

Having described a preferred embodiment of the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. The method of aspirating waste fluid material from a floor or similar surface in a surgical operating room comprising the steps of:

(a) connecting a fluid suction head to a source of negative pressure;

(b) placing said suction head on said floor;

(c) positionally sliding said suction head along said floor by applying translational forces thereto with a foot of an operator; and (d) aspirating fluid through said suction head toward said source along recessed flow channels defined in the bottom surface of said suction head.

2. The method according to claim 1 further including the step of disposing of said suction head after use in only a single surgical operation.

3. The method according to claim 1 wherein step (a) includes connecting said suction head to a source of negative pressure having a magnitude of approximately 300 millimeters of mercury.

4. The method according to claim 3 wherein step (a) includes aspirating the fluid at a flow rate in the range of approximately 600 to 750 ml/minute.

5. The method according to claim 3 further comprising the step of collecting the waste fluid material aspirated in step (b) in a waste collection chamber connected in flow communication between said source and said suction head.

6. The method according to claim 1 wherein step (b) includes aspirating the fluid through said flow channels in a plurality of radial directions from the periphery to the center of the bottom surface of said suction head.

7. The method of aspirating waste liquid from a surgical operating room floor comprising the steps of:

(a) applying suction to a suction head; and (b) by means of translational forces applied by a foot of a person, positioning said suction head along the surgical operating room floor to permit the suction at the suction head to draw the waste liquid away from the floor.

8. The method according to claim 7, further comprising the step of deriving said suction from a wall suction port in the surgical operating room.

9. The method according to claim 8 wherein the pressure of said suction is on the order to 300 mm of mercury below atmospheric pressure.

10. The method according to claim 8 wherein step (a) comprises the steps of:

(a.1) connecting a first fluid conduit between said wall suction portion and an outlet port of a waste collection chamber; and (a.2) connecting a flexible hose between a suction supply port of said suction head and an inlet port of said waste collection chamber;

such that suction from said wall suction port is applied to the suction supply port of said suction head through said waste collection chamber and said flexible hose to thereby draw waste liquid from said floor through said suction head and flexible hose into said waste collection chamber to permit waste liquid to fall into said waste collection chamber.

11. The method according to claim 7 wherein step (b) includes drawing the waste liquid through flow channels recessed in a bottom surface of said suction head.

12. The method according to claim 7 further comprising the step of disposing of said suction head after use in only a single surgical procedure.

13. The method according to claim 7 wherein fluid is drawn through said suction head and flexible hose at a flow rate in the range of approximately 600 to 750 ml/minute.

14. The method of aspirating waste liquid from a floor in a surgical operating room comprising the steps of:

(a) applying suction to said floor via a suction head connected to a flexible hose to draw matter from said floor through said suction head and said flexible hose;

(b) selectively translating said suction head along said floor by means of foot-applied translational forces imparted to the suction head by surgical operating room personnel; and (c) collecting waste liquid drawn from said floor through said suction head and flexible hose.

15. The method according to claim 14 wherein step (c) includes collecting said waste liquid in a waste collection chamber, said method further comprising the steps of:

connecting said flexible hose between a suction portion of said suction head and an inlet port of said waste collection chamber located above the bottom of the chamber;

connecting a fluid conduit between a source of said suction and an outlet port of said waste collection chamber located above the bottom of said chamber; and in response to said suction, flowing air through said waste collection chamber from said inlet port to said outlet port while permitting waste liquid that is carried by the air to fall to the bottom of the chamber.

16. The method according to claim 15 further comprising the step of providing said suction via a wall suction port whereby said fluid conduit is connected between the wall suction portion and the outlet port of said chamber.

17. The method according to claim 16 further comprising the step of providing said suction at a pressure on the order of 300 mm of mercury below atmospheric pressure.

18. The method according to claim 17 wherein step (a) includes drawing matter through said flexible hose at a flow rate in the range of approximately 600 to 750 ml/minute.

19. The method according to claim 14 further including the step of disposing of said suction head after use in only a single surgical procedure.

20. The method according to claim 14 wherein step (a) includes drawing matter from said floor through flow channels recessed in a bottom surface of said suction head.

* * * * *

UNITED STATES PATENT AND TRADEMARK OFFICE

CERTIFICATE OF CORRECTION

PATENT NO. : 5,032,184

DATED : July 16, 1991

INVENTOR(S) : Rick A. Ogilvie et al

It is certified that error appears in the above-identified patent and that said Letters Patent is hereby corrected as shown below:

Column 7, line 18, delete "portion" and replace with --port--.

Column 8, line 13, delete "portion" and replace with --port--.

Column 8, line 29, delete "portion" and replace with --port--.

Signed and Sealed this

Twentieth Day of October, 1992

*Attest:*

DOUGLAS B. COMER

*Attesting Officer*

*Acting Commissioner of Patents and Trademarks*